US005495143A

United States Patent [19]

Lengyel et al.

[11] Patent Number: 5,495,143

[45] Date of Patent: Feb. 27, 1996

[54] GAS DISCHARGE DEVICE HAVING A FIELD EMITTER ARRAY WITH MICROSCOPIC EMITTER ELEMENTS

[75] Inventors: Michael Lengyel, Ramona, Calif.; Douglas A. Kirkpatrick, Laurel, Md.; George L. Bergeron, III, Springfield, Va.; Otto J. Hunt, San Diego, Calif.; James J. Hickman, Falls Church, Va.; Stanley E. Busby, San Diego, Calif.

[73] Assignee: Science Applications International Corporation, San Diego, Calif.

[21] Appl. No.: 104,844

[22] Filed: Aug. 12, 1993

[51] Int. Cl.[6] ..... H01J 17/06; H01J 17/48

[52] U.S. Cl. ..... 313/574; 313/575; 313/309; 313/336; 313/351; 313/491; 313/631

[58] Field of Search ..... 313/309, 310, 313/336, 351, 484, 491, 574, 575, 622, 631, 632

[56] References Cited

U.S. PATENT DOCUMENTS

| | | | |
|---|---|---|---|
| 3,720,856 | 3/1973 | Brody | 313/309 |
| 3,755,704 | 8/1973 | Spindt et al. | 313/309 |
| 3,812,559 | 5/1974 | Spindt et al. | 29/25.18 |
| 4,686,414 | 8/1987 | McKenna et al. | 313/362.1 |
| 4,721,885 | 1/1988 | Brodie | 313/576 |
| 4,748,546 | 5/1988 | Ukrainsky | 362/223 |
| 4,818,914 | 4/1989 | Brodie | 315/169.3 |
| 4,911,981 | 3/1990 | Schnur et al. | 428/402.24 |
| 4,940,916 | 7/1990 | Borel et al. | 313/306 |
| 5,012,482 | 4/1991 | Gray | 313/309 |
| 5,097,231 | 3/1992 | Johnson et al. . | |
| 5,138,220 | 8/1992 | Kirkpatrick | 313/309 |
| 5,161,041 | 11/1992 | Abileah et al. | 359/40 |

FOREIGN PATENT DOCUMENTS

| | | | |
|---|---|---|---|
| 0466138 | 1/1992 | European Pat. Off. . | |
| 57-28447 | 6/1982 | Japan . | |
| 7807771 | 2/1979 | Netherlands | 313/632 |

OTHER PUBLICATIONS

IBM Technical Disclosure Bulletin, vol. 30, No. 3, Aug. 1987, New York US p. 1398, "Cold Cathode for Ultraviolet Lamp".

Hickman, et al., "Surface Composition of Si–$TaSi_2$ Eutectic Cathodes and Its Effect on Vacuum Field Emission", Appl. Phys. Lett. 61(21), Nov. 1992, pp. 2518–2520.

Kirkpatrick, et al., "Vacuum Field Emission from Si–$TaSi_2$ Semiconductor–metal Eutectic Composite", Appl. Phys. Lett., vol. 59, No. 17, Oct. 1991, pp. 2094–2096.

Kirkpatrick, et al., "Deomonstration of Vacuum Field Emission from a Self–Assembling Biomolecular Microstructure Composite", Appl. Phys. Lett., 60(13), Mar., 1992, pp. 1556–1558.

Kirkpatrick, et al., "Analysis of Field Emission from Three–Dimensional Structures", Appl. Phys. Lett. 60(17), Apr. 1992, pp. 2065–2067.

Lengyel, "Woe is the Backlight", presented at the aerospace Lighting Institute, Feb., 1992, pp. 1–12.

*Primary Examiner*—Donald J. Yusko
*Assistant Examiner*—N. D. Patel
*Attorney, Agent, or Firm*—Foley & Lardner

[57] ABSTRACT

A gas discharge device includes an envelope containing a low pressure gas and a field emitter array having microscopic emitter elements which emit electrons into the gas. The device can be employed, for example, in a gas discharge lamp.

34 Claims, 6 Drawing Sheets

GAS DISCHARGE DEVICE HAVING A FIELD EMITTER ARRAY WITH MICROSCOPIC EMITTER ELEMENTS

BACKGROUND OF THE INVENTION

The invention is directed toward an improved gas discharge device. More specifically, the invention is directed toward a gas discharge device which uses an array of microscopic electron emitters operating under the principles of field emission to initiate and sustain a discharge. The invention provides a gas discharge device with numerous advantages over conventional gas discharge devices. The invention can be employed, for example, in gas discharge lamps such as fluorescent lamps as well as in a wide variety of non-lighting applications.

A gas discharge requires a source of free electrons that can migrate from a cathode to an anode while ionizing a background gas and propagating the discharge. At the cathode, the electrons are conventionally generated by thermionic or secondary emission processes. Thermionic emission processes employ a low work function material which is raised to a high temperature to liberate electrons into the surrounding environment. Secondary emission processes employ a material with a high secondary electron yield coefficient to liberate electrons when the cathode is impacted by ions, other electrons, or photons.

Thermionic emission cathodes are typically fabricated from combinations of rare metals such as barium, strontium, scandium and others as the emitter material. The combinations of materials are chosen for their low work function and low evaporation rate because the former determines the temperature that the cathode must be raised to and the latter determines the operating life of the cathode. The emitter material is heated to extremely high temperatures for operation, typically greater than 1000° C. At operating temperatures, the thermal distribution of electrons in the emitter material allows a significant number of electrons to have a thermal kinetic energy greater than the binding energy of the material. This renders these electrons effectively free of the material and therefore permits these electrons to be easily drawn off by an applied external field.

The operational characteristics of thermionic emission cathodes also dictate their shortcomings. First, the cathode must be heated to very high temperatures in order to produce a significant number of free electrons. This heating requires power which must normally be externally applied. In some cases this power can be derived from the back-bombardment of the emitter in a gas discharge. Second, the emissive material on the cathode slowly boils off into its surrounding environment at the required elevated cathode temperatures. This rate of boil-off typically determines the cathode operational lifetime. This boiled-off material can also have deleterious effects on the performance of other chemically sensitive materials in the gas discharge device, such as phosphors. Finally, the elevated cathode temperatures render the cathode materials moderately chemically reactive, and therefore care must be taken in engineering the surrounding environment such that other materials in the system do not react with and poison the cathode emissive materials.

Cathodes designed to use secondary electron emission processes rely on incident ions, electrons, or photons to initiate a cascade which can then be self-supporting. An incident particle must be energetic enough to eject one or more electrons from the cathode material if the number of particles in the arc stream is to be stable or increasing. In the arc stream geometry in a gas discharge, electron emission from the cathode will primarily be due to ion impact. The incident ions also couple significant energy to the cathode substrate as a result of the surface collision, resulting in a net energy loss from the device beyond the energy required to liberate the counter-propagating electrons. This large inefficiency is a primary reason to avoid secondary emission cathodes whenever possible.

A gas discharge lamp is a lamp which produces light by exciting gas atoms using an electric current. FIG. 1 illustrates a simplified example of a conventional gas discharge lamp in the form of a fluorescent lamp 100. The body of fluorescent lamp 100 consists of a tubular glass or quartz envelope 110. The envelope 110 can be formed in a wide variety of shapes and sizes. The inside surface of envelope 110 is coated with a blend of photoluminescent phosphors 115. Photoluminescent phosphors are phosphors that emit visible light when stimulated by ultraviolet light.

Envelope 110 is filled to a low pressure, typically 2 to 10 Torr, with argon gas or krypton gas and a small amount of mercury. The mercury is condensed into its metalloid state at room temperature and is converted into a gaseous form at normal operating temperatures. The mercury atoms produce ultraviolet and visible light photons when the atoms are excited by electrons through collisional excitation. The argon gas or krypton gas serves as a buffer gas and promotes ionization inside the envelope 110.

In a conventional hot cathode fluorescent lamp, both ends contain both a thermionic cathode and an anode structure. These are illustrated in FIG. 1 as anode/cathode 120 and cathode/anode 130. The applied voltage to the lamp oscillates such that the cathode at one end and the anode at the opposite end are energized during one-half of an AC cycle (e.g., 60 Hz) and then the roles of each end reverse during the other half of the cycle. During any given half-cycle, a cathode serves to release electrons into the arc stream. The anode at the opposite end of the lamp serves as the main recipient of the electrons and as a current carrier for the lamp. An anode is typically fabricated from molybdenum wires or another refractory metal or metal alloy. Due to the heating of the anode, a refractory metal is required if the anode is not to be rapidly ablated during lamp operation.

If ultraviolet light is desired instead of visible light, then the phosphor coating is omitted and the lamp envelope is fabricated from a material that will efficiently pass ultraviolet light, such as quartz. Ultraviolet light sources are used, for example, for water purification.

Conventional gas discharge lamps have numerous drawbacks directly related to the cathode, such as a relatively short lamp life and susceptibility to mechanical damage. Conventional hot cathode fluorescent and ultraviolet lamps require electric power just to keep the cathode(s) hot. This wastes energy. Conventional cold cathode fluorescent and ultraviolet lamps are even less efficient because the cathodes in these lamps have a higher cathode fall voltage (the cathode fall voltage is the potential difference between the arc stream and the cathode).

Accordingly, there is a real need for an improved technique for producing a gas discharge.

SUMMARY OF THE INVENTION

Accordingly, it is an object of the invention to provide an improved technique for initiating and sustaining a gas discharge using a field emitter array having microscopic emitter elements as the cathode.

Another object of the invention is to provide a field emitter array with suitable geometry and materials characteristics for long life performance in a gas discharge environment.

Another object of the invention is to provide an improved gas discharge lamp utilizing a field emitter array having microscopic emitter elements as a cathode.

Another object of the invention is to provide a wide variety of gas discharge lamps, such as fluorescent and neon lamps, which generate light with higher efficiency than conventional lamps and which have a longer life and improved reliability as compared to conventional lamps.

According to a first aspect of the invention there is provided a gas discharge device which includes an envelope containing a low pressure gas. A field emitter array is positioned within the envelope and forms a cathode. The field emitter array includes microscopic emitter elements which emit electrons into the gas. An anode is positioned within the envelope and is spaced from the cathode. A first conductor is connected to the cathode and a second conductor is connected to the anode for supplying a voltage potential between the cathode and the anode upon operation of the gas discharge device. This voltage potential creates a gas discharge that closes the circuit between the cathode and the anode. Typically, the gas is at a pressure between 0.1 Torr and 10 Torr and the microscopic emitter elements include rods which protrude from a matrix and which have a maximum cross-sectional dimension less than 100 microns.

According to another aspect of the invention there is provided a gas discharge lamp which includes an envelope containing a gas which emits photons when the gas is excited by electrons. The envelope is at least partially transparent to emit light. A field emitter array includes microscopic emitter elements which emit electrons into the gas to excite the gas. In a preferred embodiment, the gas is mercury. A phosphor coating can be provided to convert photons emitted by the gas into visible light.

Other objects, features, advantages, and applications of the invention will become apparent from the detailed description of preferred embodiments set forth below.

BRIEF DESCRIPTION OF THE DRAWINGS

Preferred embodiments of the invention will be described below with reference to the accompanying drawings, wherein.

DETAILED DESCRIPTION OF PREFERRED EMBODIMENTS

In the instant invention, a field emitter array having microscopic emitter elements is employed to produce electrons for a gas discharge. The gas pressure is generally between 0.1 and 10 Torr. The gas discharge can be used, for example, to produce light.

The invention can be carried out in a wide variety of ways and has applicability to a wide variety of applications. By way of example and not by limitation, the invention can be applied to commercial lighting and display backlighting applications, to wastewater treatment, to ultraviolet curing of thin films, and to high power electronic protection devices. Therefore, it will be appreciated that the invention is not limited to the detailed designs described below but will instead vary depending on the specific application at hand, manufacturing concerns, cost, and the like.

Unlike either the thermionic emission or secondary emission processes, field emission processes use a very high electric field stress at the surface of the cathode material to directly liberate electrons from the cathode through quantum tunneling. This process is therefore sometimes referred to as quantum field emission. The external fields required for this phenomena to occur with high probability are on the order of $10^6$ to $10^8$ V/cm, depending on the desired emission current density and the work function of the cathode material. Such large external fields are normally only achieved in resonant radio-frequency accelerator cavities, or near structures with very sharp surface features that dramatically enhance the average applied field. A type of cathode has been developed which exploits this latter design by employing a high density array of microscopic sharp tips in which each tip acts as a field emitter source of electrons. Such cathodes are typically referred to as field emitter arrays.

Field emitter arrays have been fabricated from a wide variety of emitter materials including silicon, molybdenum, gallium-arsenide, diamond, and tantalum-disilicide. All of these field emitter arrays achieve the large fields necessary for field emission through the use of microscopic structures with sharp surface features such as pointed cones or wedges. Most of the field emitter array research has focussed on their use in vacuum electronic devices, and most field emitter arrays require sensitive treatment in ultra-high vacuum systems with pressures of approximately $10^{-8}$ Torr. The sensitivity of field emitter arrays to their background environment is influenced primarily by two factors: the chemical stability of the emitter materials and the effects of ion back-bombardment on the emitter structure.

Figure 1:
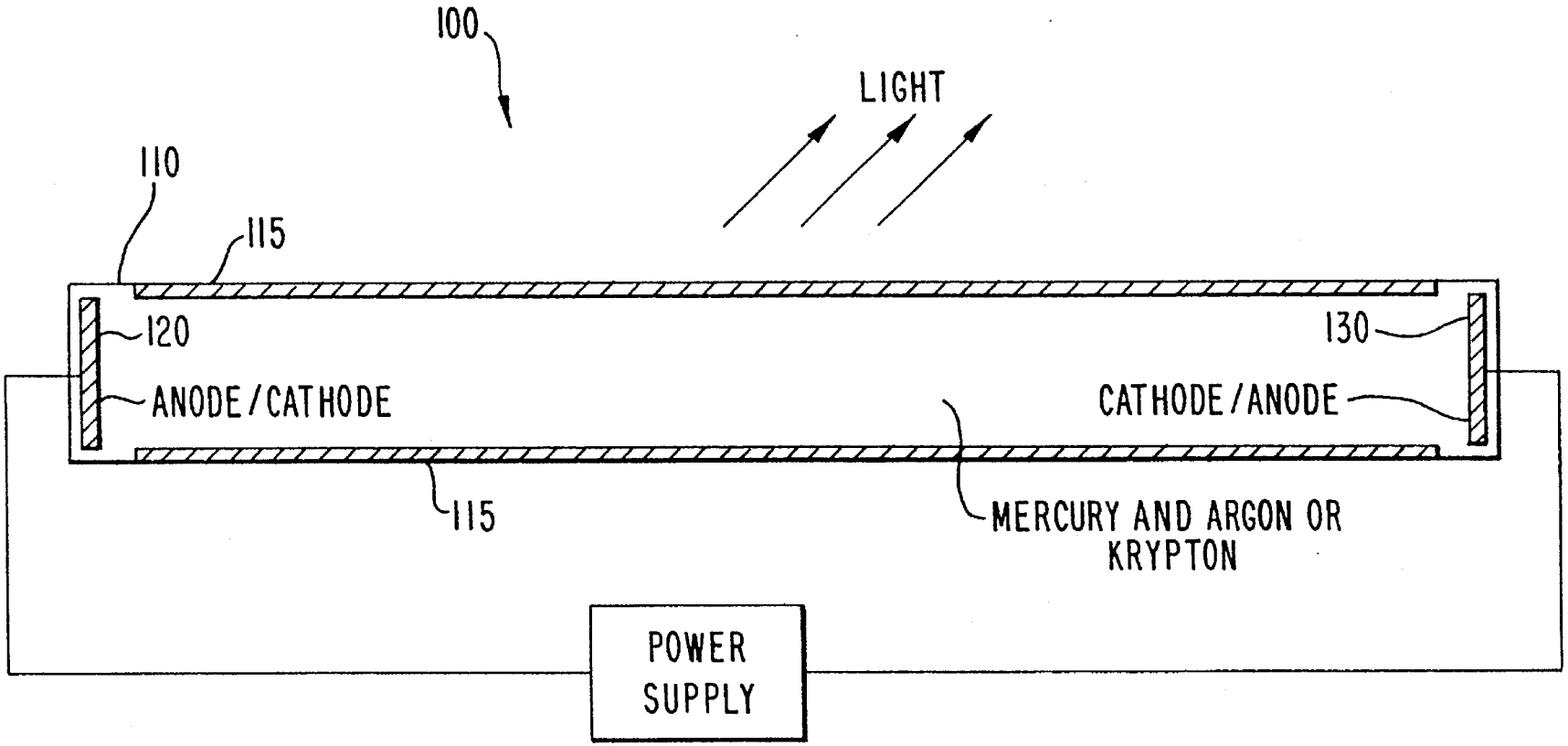
FIG. 1 PRIOR ART
FIG. 1 illustrates a conventional fluorescent lamp.
Figure 2:
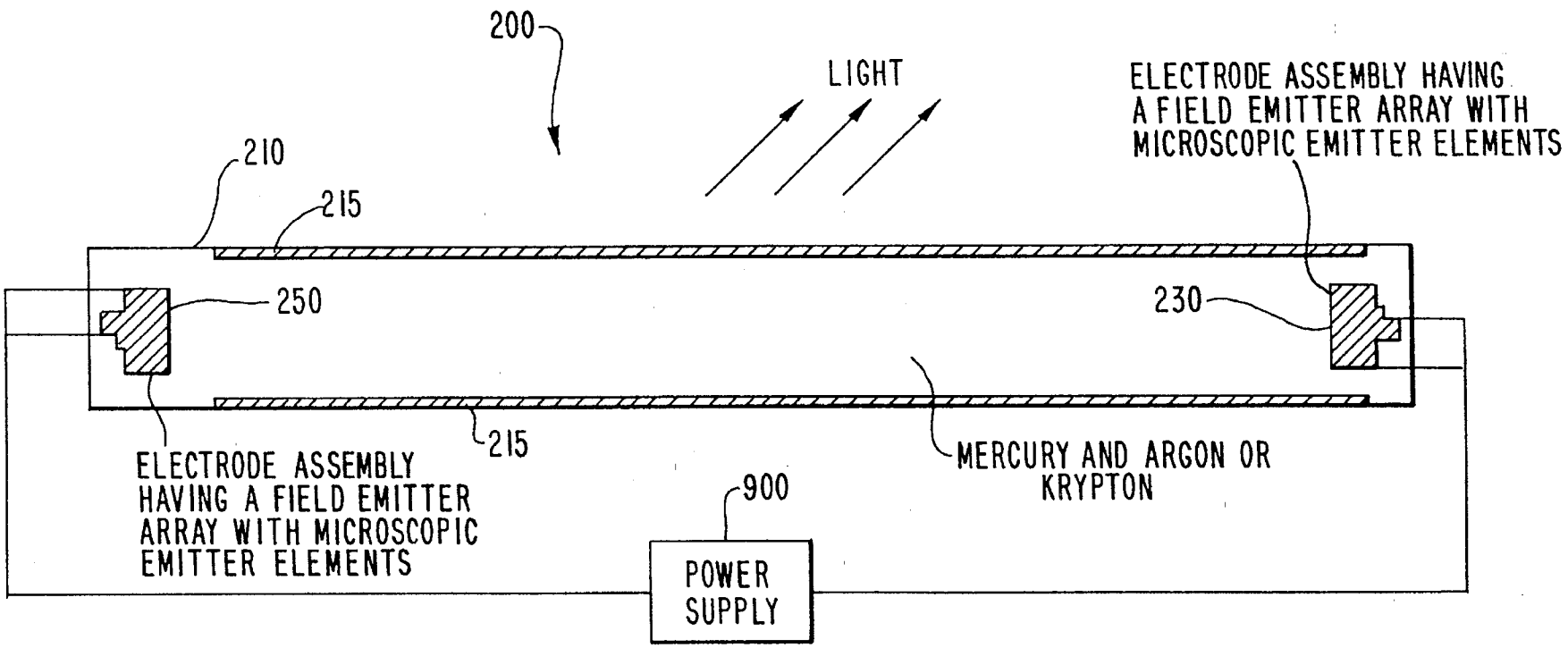
FIG. 2 illustrates a lamp according to a preferred embodiment of the invention.

FIG. 2 illustrates one preferred embodiment of the invention in the form of a gas discharge lamp 200. The lamp 200 includes an envelope 210 which is fabricated from glass or quartz. A quartz envelope is preferred when the lamp is to be operated as a source of ultraviolet light. The inside surface of the envelope 210 may be coated with a conventional photoluminescent phosphor coating 215. The envelope 210 is filled to a low pressure with an inert gas such as argon or krypton and with a small amount of mercury.

Two identical cathode-anode electrode assemblies 230 and 250 are provided within the envelope 210 to alternately produce and collect electrons. When a voltage potential is applied between assemblies 230 and 250, a gas discharge is created between the two assemblies. The gas discharge closes, or completes, the electrical circuit between the two assemblies.

The assemblies are alternately energized by an AC (alternating current) power supply 900 such that when the assembly 230 is acting as a cathode, the assembly 250 is acting as an anode, and vice versa. The detailed configuration of the assemblies 230 and 250 will be described below.

For the sake of the present discussion, we will limit our discussion to one phase of the energizing cycle in which the assembly 230 is used to produce electrons and the assembly 250 serves as an electron collector. It will be understood to those skilled in the art that a wide variety of oscillatory waveforms can be used to excite the discharge. For some purposes, for example, certain high power electronic protection devices, DC (direct current) voltages may also be used.

Assembly 230 is connected to a first potential, e.g., +770 volts, and assembly 250 is connected to a second potential, e.g., ground. Assembly 250 is thus capable of supplying a virtually unlimited supply of electrons. The gas between the assembly 250 and the assembly 230 provides a path for arc propagation.

In contrast to conventional hot cathode and cold cathode lamps, the cathode in assemblies 230 and 250 of the instant invention employ a field emitter array having microscopic emitter elements to emit electrons into the envelope 210. The instant invention does not change the general nature of the arc propagation in a gas discharge apart from the nature of arc generation and propagation near the assemblies 230 and 250.

Figure 3:
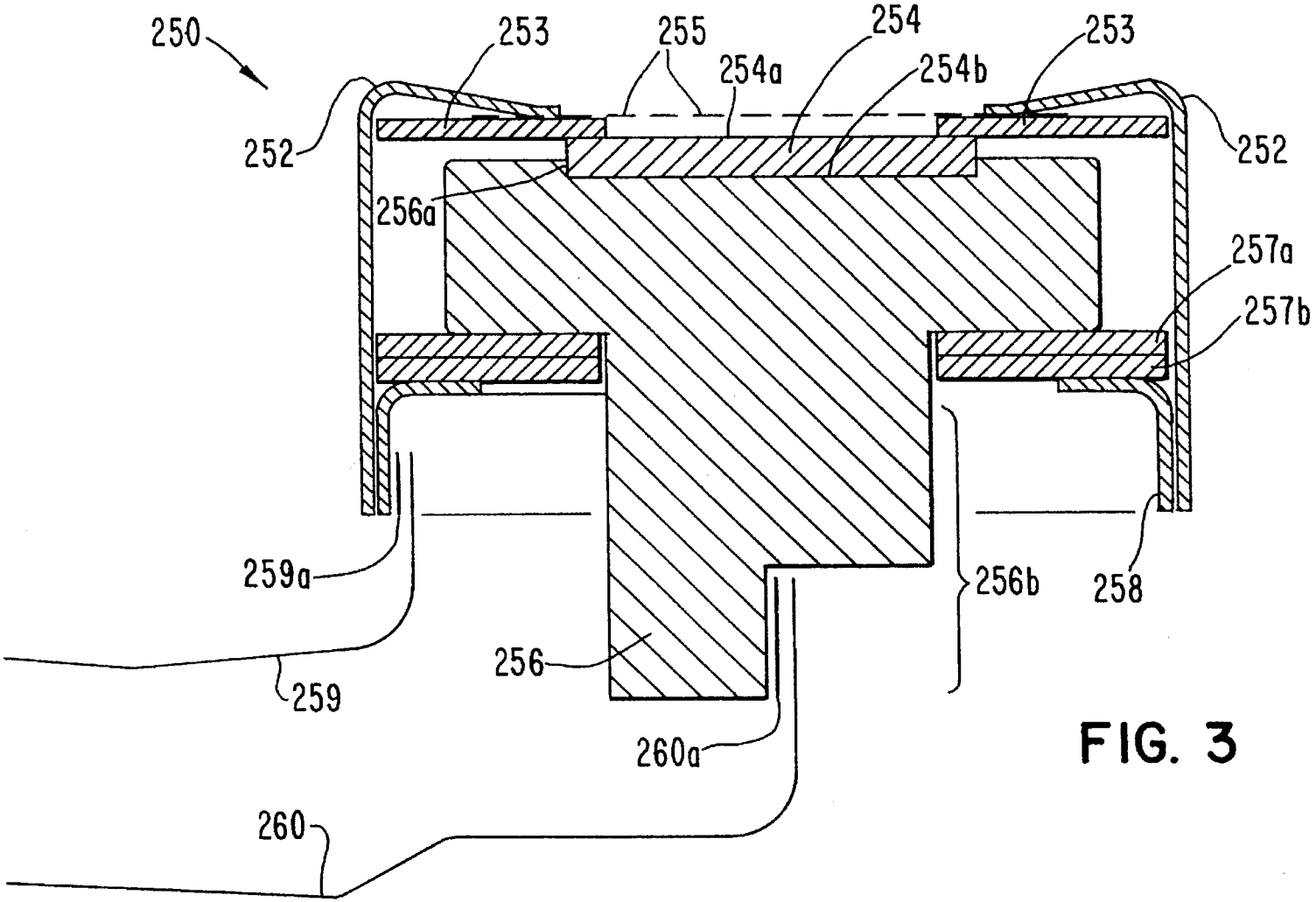
FIG. 3 is a detailed illustration of an electrode assembly of FIG. 2.

FIG. 3 illustrates a detailed view of electrode assembly 250. Assembly 230 is identical to assembly 250. As illustrated in FIG. 3, the assembly 250 includes a collecting anode 252 to collect electrons when the assembly is serving as an electron collector and a field emitter array 254 having microscopic emitter elements to emit electrons when the assembly 250 is serving as an electron source. The collecting anode 252 in this embodiment is a flat annulus. A metal mesh 255 covers the aperture in the annulus opposite the field emitter array 254. Mesh 255 is in electrical contact with anode 252 and also collects electrons when the assembly 250 is serving as an electron collector. Alternate geometries which provide the same general electric field structure in front of the field emitter array 254 can be used instead of a flat annulus and a screen.

Good conducting refractory metals such as tungsten or molybdenum or comparable alloys are preferred for the anode and mesh materials in most applications. However, lower melting point metals or alloys such as nickel may be suitable for low power density applications. During lamp operation, a very small amount of the anode and/or mesh material may come off of either assembly. Therefore, materials which could coat or oxidize the field emitter array 254, such as iron, should be avoided in the anode 252 and the mesh 255.

Figure 4A:
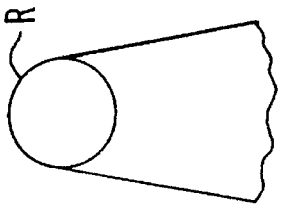
FIG. 4A shows a detailed view of a microscopic emitter element.
Figure 4:
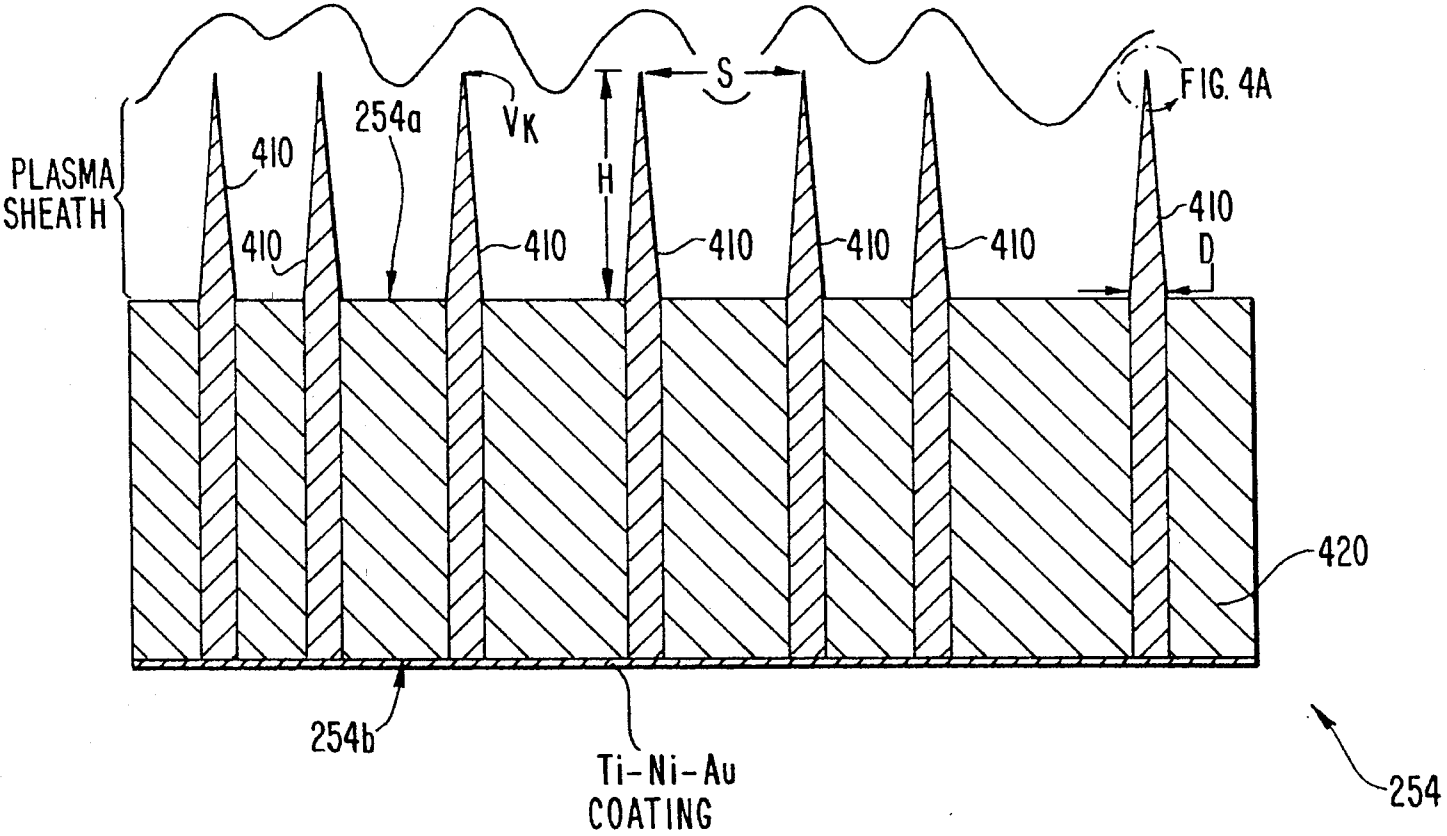
FIG. 4 illustrates various parameters of a field emitter array having microscopic emitter elements.

FIG. 4 illustrates the basic parameters of the field emitter array 254. In this embodiment, the field emitter array 254 consists of an array of microscopic tantalum disilicide rods 410 encased in a silicon substrate 420. The rods are oriented approximately perpendicular to the main surface of the substrate and protrude from the front surface 254*a* of the array facing mesh 255. The portion of a rod above the surface of the substrate forms a microscopic emitter element. These rods that are illustrated in FIG. 4 are not visible in FIG. 3 because they are too small to be seen with the naked eye. In this particular embodiment, the portions of the rods above the surface of the substrate are not coated with any protective material because the rods will not chemically react with the argon or krypton and mercury in envelope 210. However, in some applications the tips should be coated to make them chemically inactive. For example, in a water vapor environment, the tips should usually be coated with gold or another material to make them chemically inert.

Under the influence of an applied electric field, the tantalum disilicide rods each act as a microscopic quantum field emitter. The emitters in the field emitter array are typically characterized by their height H, their average lateral separation S, the average tip radius of curvature R, and the maximum cross-sectional dimension D of a rod at its base. When the rods are circular in cross-section, the maximum cross-sectional dimension is the rod diameter.

Figure 5:
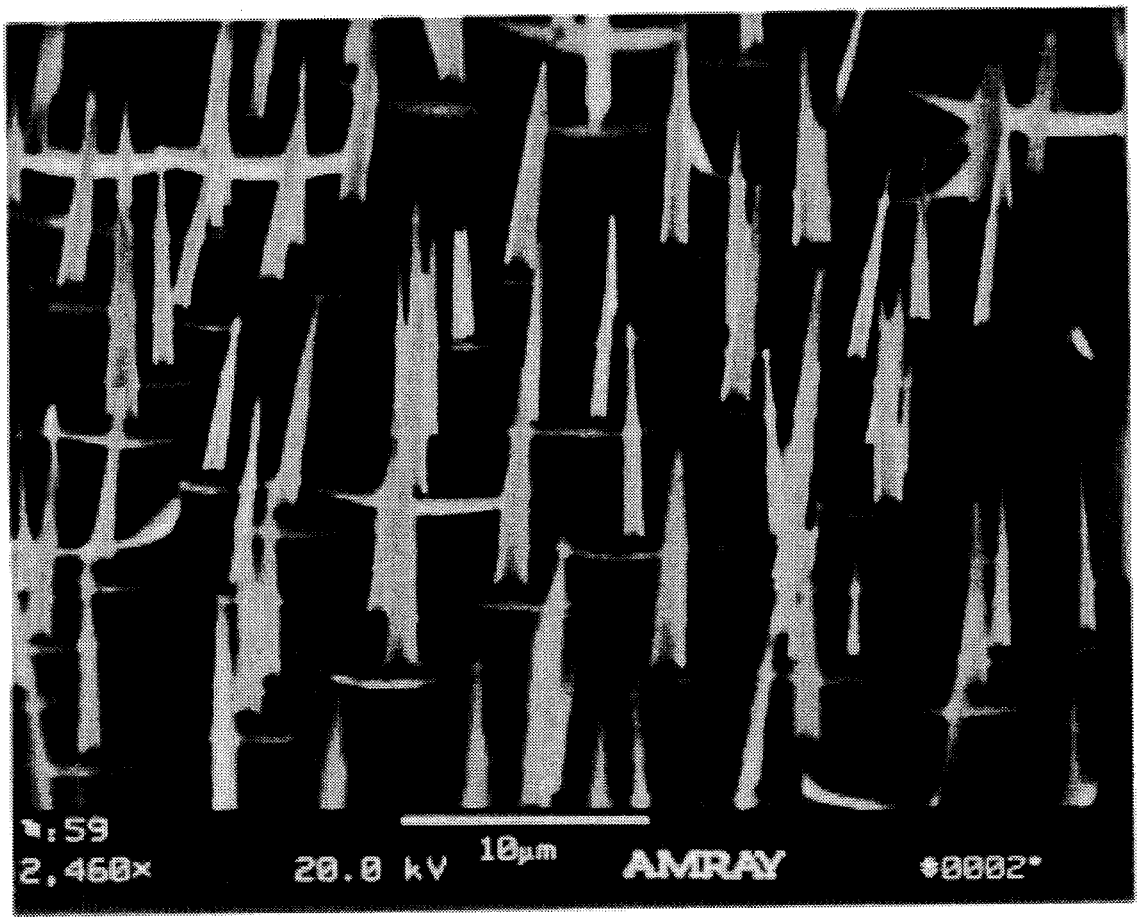
FIG. 5 is a photograph of a field emitter array having microscopic emitter elements suitable for use in the embodiment illustrated in FIGS. 2, 3, and 4.

FIG. 5 is an SEM (scanning electron microscope) photograph of the surface of the field emitter array facing the mesh 255, magnified 2,460 times. The photograph includes a 10 μm (10 micron) scale for reference. In the photograph, the white-colored pointed spikes are the ends of the tantalum disilicide rods. The black portion in the photograph is the silicon substrate.

In this embodiment, the rods extend to a height H approximately 8.0 to 8.1 microns above the surface of the silicon substrate, have a tip radii of curvature R of between 80 and 120 angstroms, and have an areal density of approximately $10^6/cm^2$, which corresponds to an average lateral separation S of approximately 10 microns. It is important that the geometry of the rods above the surface of the substrate be relatively uniform from rod to rod to ensure that current draw through the rods throughout the array is relatively uniform. Depending on the application at hand, the rods can have a maximum cross-sectional dimension D between 0.01 and 100 microns, a height H between 0.5 and 100 microns, and an areal density between $10^4/cm^2$ and $10^8/cm^2$.

In this particular embodiment, the silicon substrate of array 254 is 0.5 millimeters thick. The tantalum disilicide rods pass completely through the silicon substrate to the back surface 254*b* not facing mesh 255. The ends of the rods are flush with back surface 254*b*. Electrical contact to the rods is made via a Ti—Ni—Au (titanium-nickel-gold) coating on surface 254*b*. The Ti—Ni—Au coating is formed by successively coating surface 254*b* with evaporated films of titanium (approximately 50 nanometers), nickel (approximately 150 nanometers), and gold (approximately 500 nanometers) and then annealing the array 254 and the coating at a temperature of about 350° C. for about 15 minutes. The Ti—Ni—Au coating contacts both the rods and the substrate and serves to bridge Schottky barriers between the rods and the substrate in addition to providing an electrical contact for the array. The Ti—Ni—Au coating is not visible in FIG. 3 because it is too thin to be seen in a side view with the naked eye.

Electrons travel from the Ti—Ni—Au coating up through each of the rods and are emitted from the pointed ends of the rods. A relatively thick substrate is desirable because the substrate serves as a heat sink for the heat generated in the tantalum disilicide rods by this electron current flow. A relatively thick substrate also means that the length of a rod from the portion of the rod contacting the Ti—Ni—Au coating to the very tip of the rod, which emits electrons, is relatively long. This length provides some electrical resistance in the rod, which helps ensure that the rod does not carry too much electric current.

It has been found that silicon-tantalum disilicide arrays having microscopic emitter elements are particularly advantageous in many applications because they have a fairly uniform microstructure, excellent thermal conductivity properties, and are relatively inert at high temperatures. Unlike other materials, the thermal conductivity of tantalum increases with increasing temperature. This property of tantalum helps keep the emitters at an acceptable temperature.

Returning now to FIGS. 3 and 4, the dimensions and other construction details of a particular assembly which has been demonstrated in the laboratory will now be described. The collector anode 252 and the field emitter array 254 are maintained 0.50 to 0.25 millimeters apart by an annular-shaped ceramic ring 253. The outer diameter of this ring is approximately 9 millimeters and the inner diameter is approximately 5 millimeters. In this embodiment the ring 253 is fabricated from a ceramic such as MACOR. The mesh 255 is affixed between the ring 253 and the collector anode 252. The field emitter array 254 is positioned within a depression 256*a* machined into a tungsten cathode contact 256. The dimensions of this contact 256 are such that two additional ceramic rings 257*a* and 257*b* fit over a post end 256*b* of contact 256 opposite the field emitter array 254. The rings 257*a* and 257*b* have dimensions identical to ring 253 and are fabricated from a ceramic such as MACOR.

This entire assembly is contained within the can formed by the collector anode 252, as shown in FIG. 3. A containing ring 258 is press fitted into the opening in the rear of the collector anode 252 and compresses against the ceramic ring 257*b*. The containing ring 258 is spot welded into place to prevent movement of the internal components. Contact wires 259 and 260 are affixed to containing ring 258 (which is in electrical contact with the collector anode 252) and cathode contact 256, respectively, by contacts 259*a* and 260*a*.

In a laboratory set-up, leads 259 and 260 for assembly 230, serving as an electron collector, were connected to a +770 volt power supply and leads 259 and 260 for assembly 250, serving as an electron source, were connected to ground. When the lamp 200 was operated using DC power, it drew several milliamps and produced visible and ultraviolet light.

The process of vacuum field emission is very sensitive to the work function of the emitter surface. Reaction of the emitter material with the outside environment is one potentially disastrous situation to be avoided because thin layers of surface oxides can alter the field necessary to achieve a given emission current by more than a factor of three. A second interaction possibility is the absorption of gas molecules into the emitter surface, without an actual chemical reaction of the materials. These absorbed molecules can significantly degrade performance by modifying the work function of the emitter surface.

An additional effect of ion back-bombardment is the direct result of the emission process. Positive ions are created in the discharge volume by collisions of the emitted electrons with background gas neutrals or by sputtering the anode material. These positively charged ions then propagate toward the cathode and may strike the cathode with a kinetic energy determined by where in the discharge volume the ions were formed. The degree of subsequent sputtering of the emitter structure depends on the design of the field emitter array, the design of the discharge volume, the emitter material, the anode material, and the background gas pressure.

Field emitter arrays having microscopic emitter elements can be made from other materials and/or can have other dimensions and other areal densities than those described above. Moreover, a wide variety of other metals can be used instead of Ti—Ni—Au for the coating on back surface 254*b* of array 254. For example, suitable field emitter arrays having microscopic emitter elements can be formed from other eutectic composites such as niobium, tungsten, or molybdenum composites; from gallium-arsenide patterned devices; and from bio-molecular devices. The Ti—Ni—Au coating can be replaced with a platinum-titanium-tungsten coating if a high temperature coating is required, for example, for manufacturing reasons. This latter contact is applied by first depositing a titanium-tungsten alloy with 5–15% titanium content (approximately 100 nanometers) followed by the deposition of platinum (approximately 20 nanometers).

General background information and detailed technical data on field emitter arrays having microscopic emitter elements are set forth in U.S. Pat. No. 5,138,220, entitled "Field Emission Cathode of Bio-Molecular or Semiconductor-Metal Eutectic Composite Microstructures" and issued on Aug. 11, 1992 to Douglas A. Kirkpatrick; "Surface Composition of Si—$TaSi_2$ Eutectic Cathodes and Its Effect on Vacuum Field Emission," Applied Physics Letters, James J. Hickman et al., Vol. 61, No. 21, Nov. 23, 1992, page 2518; "Analysis of Field Emission From Three-Dimensional Structures," Applied Physics Letters, D. A. Kirkpatrick et al., Vol. 60, No. 17, Apr. 27, 1992, page 2065; "Demonstration of Vacuum Field Emission From a Self-Assembling Biomolecular Microstructure Composite," Applied Physics Letters, Vol. 60, No. 13, Mar. 30, 1992, page 1556; and "Vacuum Field Emission From a Si—$TaSi_2$ Semiconductor-Metal Eutectic Composite," Applied Physics Letters, Vol. 59, No. 17, Oct. 21, 1991, page 2094. The contents of these documents are incorporated herein by reference.

The physics of operation of the lamp 200 will now be described in detail.

When a voltage difference is applied between assembly 230, serving as an electron collector, and assembly 250, serving as an electron source, an electrostatic field is created in the vicinity of the field emitter array 254 in assembly 250. In the vicinity of the tips of the tantalum disilicide rods, shown in FIGS. 4 and 5, this electrostatic field is enhanced sufficiently to cause electrons to be liberated from the tips of the tantalum disilicide rods. This voltage difference also creates an arc between assembly 230 and assembly 250.

The electron emissions from the field emitter array 254 are truly cold emissions—they do not require a thermal release mechanism. Neither do they require back-bombardment from the arc stream, although back-bombardment of the silicon matrix and anode structure of the assembly 230 may contribute some current to the arc stream. After the electrons are liberated from the array 254 of assembly 250, they move toward the mesh 255 of assembly 250, pass through the mesh 255, and move across the length of the lamp from left to right in the direction of assembly 230 as a result of the potential difference between the assembly 250 and the assembly 230. The function of assembly 230 is to provide a path for current flow by collecting electrons at the end of the lamp opposite assembly 250.

As the electrons move across the length of the lamp from left to right in FIG. 2, the electrons collide inelastically with electrons in the outer electron shells of mercury atoms within the envelope 210 and excite the mercury atoms. When these mercury atoms relax, they emit light (albeit invisible) in the form of 186 and 254 nanometer ultraviolet photons. These 186 and 254 nanometer ultraviolet photons in turn react with the phosphor coating 215 to produce visible light.

As electrons move from left to right in FIG. 2, positive ions move from right to left. These ions are either neutralized or absorbed in the vicinity of assembly 250. During AC operation, in the second half-cycle, the electrons move from right to left and the ions move from left to right.

The lamp 200 is more efficient than hot cathode lamps because the lamp does not require electric power to keep the cathode(s) hot. Moreover, the cathodes used in the instant invention are much more stable in background gas impurities that are intolerable for conventional hot filament cathodes.

Moreover, the cathode of the instant invention is also not subjected to materials loss as electrons are emitted. This permits the invention to operate under high drive conditions without a degradation in performance. It is conservatively estimated that the MTBF (mean time between failure) for a lamp using the instant invention is four times longer than the MTBF for conventional hot filament gas discharge lamps. The invention is particularly advantageous in lighting applications where it is undesirable to use a hot filament, such as in mines or other areas that contain explosive materials, and in situations where long life and reliability are critical, such as in nuclear facilities.

The geometry, design, and operating conditions of the instant invention result in the creation of a plasma sheath around the emitter tips of the field emitter array 254 as well as the creation of a ground plane at mesh 255. As illustrated in FIG. 4, the plasma sheath extends from the surface of the silicon matrix and the rods. The plasma sheath and ground plane shield the emitter tips from ion back-bombardment, thus greatly extending the life of the array.

The parameters of the sheath also establish the characteristic Debye length over which the potential difference between the cathode, at potential $V_K$, and the arc plasma, at potential $V_P$, drops. This difference between $V_K$ and $V_P$ is sometimes called the cathode fall voltage. The Debye length $\lambda_D$ is given by $\lambda_D=v_{Te}/\omega_{pe}$, where $v_{Te}$ is the electron thermal velocity and $\omega_{pe}$ is the electron plasma frequency in the plasma sheath. The plasma sheath potential scales at approximately $e^{-x/\lambda_D}$ where x is the distance above the cathode surface structure and $\lambda_D$ is the Debye length. The $1/e^{th}$ length of the plasma sheath is on the order of the height H of the tips and corresponds to line L in FIG. 4. General background information on plasmas is set forth in Principles of Plasma Physics by Krall and Trivelpiece (McGraw Hill 1973) and the references cited therein. The contents of this book are incorporated herein by reference.

The plasma sheath acts as a virtual anode to extract electrons off of the rods. To avoid shorting out the device or otherwise adversely affecting the plasma, it is important not to adversely perturb the plasma sheath. Accordingly, structures other than the rods themselves should not be placed within the sheath.

For nominal parameters for gas discharges used in lighting applications, $\lambda_D$ is typically in the range of 1 to 10 microns. The potential difference between the emitter tips, at potential $V_K$, and the arc plasma, at potential $V_P$, appears over this short distance and is further enhanced by the structure of the emitter tip. The precise enhancement of the field due to the emitter structure is dependent on the details of the plasma sheath, and is best calculated accurately with advanced numerical simulation tools. An approximate value of enhancement can be calculated from the ratio of the Debye length to the emitter tip radius of curvature. This calculation results in a field enhancement factor of between 100 and 1000. A potential difference between the emitter tips and the arc plasma of 1 volt thus produces a local electric field at the emitter tip apex of $10^7$ to $10^8$ V/cm. This level of a local electric field produces emitted current densities of several amperes to tens of amperes per square centimeter when averaged over the macroscopic field emitter array area.

The cathode fall voltage for a thermionic emission cathode is typically about 10 volts, while that of a secondary emission cathode may be approximately 60 volts. These are the respective voltage differences required by these types of emitters to emit sufficient electron current to maintain the arc stream. By contrast, the above analysis indicates that the fall voltage associated with the field emitter array in many applications is on the order of or less than one volt.

The arrangement of FIG. 3 can also be configured to create a gas discharge which itself serves as a source of free electrons. These free electrons can in turn be used, for example, for ionizing a gas.

In this configuration, the voltage supplied to wires 259 and 260 differ by several hundred volts. In one application, wire 259 is supplied with 300 volts and wire 260 is grounded to 0 volts. When supplied with these voltages, array 254 forms a cathode (an electron emitter) and mesh 255 forms an anode (an electron collector). A gas discharge is formed between array 254 and mesh 255 that completes the electrical circuit between array 254 and mesh 255. This gas discharge produces free electrons that migrate into the area surrounding the gas discharge. The mesh can be replaced with other anode structures that perform the same functions as the mesh.

An example of how the instant invention can be employed in another specialized application will now be described to illustrate other features and advantages of the invention.

Application Example

Backlighting Military Flat Panel Displays

Many types of modern military equipment, such as military avionics, employ flat panel displays such as active matrix liquid crystal displays (AMLCDs) to provide information to the equipment operator. These displays require a source of light called a backlight. General background information on flat panel displays can be found in U.S. Pat. No. 5,161,041, entitled "Lighting Assembly for a Backlit Electronic Display Including an Integral Image Splitting and Collimating Means" and issued on Nov. 3, 1992 to Adiel Abileah et al.; and U.S. Pat. No. 4,748,546, entitled "Fluorescent Backlighting Unit" and issued on May 31, 1988 to Orest J. Ukrainsky. The contents of these patents are incorporated herein by reference.

Displays designed for military use place numerous requirements on the source of the backlight. Daylight readability requirements for a display typically require that the display provide luminance levels in excess of 150 foot Lamberts, whereas dimmed light requirements for some applications are on the order of 0.5 foot Lamberts or less. Accordingly, many military applications require that a display have a large bright-to-dim ratio.

Furthermore, the display cannot be susceptible to detection by night vision imaging systems (NVIS). The display is considered compatible with NVIS if its emissions throughout the NVIS sensitivity spectrum are held in check so as not to interfere with the automatic brightness control (gain) built into NVIS. Night vision goggle compatibility limits are set forth in military specification number MIL-L-85762A. In summary, these limits set forth maximum values for near-infrared radiation (620–930 nanometers) that can be emitted by a display or other lighted device and not interfere with the sensitivity of the goggles.

At the present time, two alternative lamp technologies are employed to back illuminate a flat panel display in non-military applications: hot cathode lamps and cold cathode lamps.

Conventional cold cathode lamps can not be used as backlights in military equipment because they can not be dimmed to the extreme limits required for nighttime military applications. At low to moderate drive conditions the high voltage gradient requirements for lamp operation can not be met and the lamp simply goes out. Thus, conventional cold cathode lamps are not suitable for use as military flat panel display backlights.

Unfortunately, the use of hot cathode lamps for backlighting military flat panel displays is not without shortcomings. To date, the most popular way of backlighting a military flat panel display is to use hot cathode serpentine-shaped fluorescent lamps in a reflecting cavity along with a diffuser to provide balanced luminance. Hot cathode fluorescent lamps are popular because they are a proven technology with a moderately low risk of failure. The trade-off for this low risk is low to marginal performance with regard to providing high luminance for daylight readability, long life, adequate dimming capability, sufficient structural integrity, and low power consumption., Use of hot cathodes also makes the equipment susceptible to detection by night vision imaging equipment due to a large near-infrared component that results from the very high temperature of the filament.

Moreover, the materials that are commonly used in flat panel liquid crystal displays are highly effective at selective attenuation of visible light. However, these materials are very ineffective at attenuating the near-infrared component of light generated by hot filament lamps to which the NVIS goggles are most sensitive. Flat panel displays for military use are also subject to stringent requirements for the dynamic range of usable intensities i.e., dimming and brightness requirements. Typical requirements are to provide dimmability over a 2000:1 range. These requirements are set to provide full sunlight readability and to be compatible with NVIS goggle requirements.

Dimming a hot cathode fluorescent lamp literally requires starting and stopping the lamp over and over again at a low but controlled rate of repetition. The lamp luminance is the average of the momentary peak luminance and the decay luminance of the phosphor. High required ignition voltages and a high required rate of repetition cause cathode material loss in a fashion similar to the cathode material loss that occurs when operating the lamp at high luminance. Thus, dimming a hot cathode lamp greatly shortens the life span of the lamp.

By contrast, in a lamp employing the instant invention the cathode does not undergo material loss. The operating time of the cathode is only that time during the emission cycle which the cathode is actually on. Thus, dimming a lamp employing the instant invention by variation of the lamp duty cycle does not greatly shorten the life span of the lamp.

Hot filament lamps are also not well suited to military shock and vibration environments. Under military shock and vibration conditions, the coils that form the fragile lamp filament collapse together, burn out, and/or simply open as a result of mechanical stress.

In contrast, a lamp employing the instant invention has a rugged construction that is not subject to failure due to shock and vibration. The instant invention has no fragile components, such as coils, which are prone to failure under shock and vibration conditions. The electron emitter in the instant invention is a block of material which is capable of withstanding considerable shock and vibration without damage.

Figure 6:
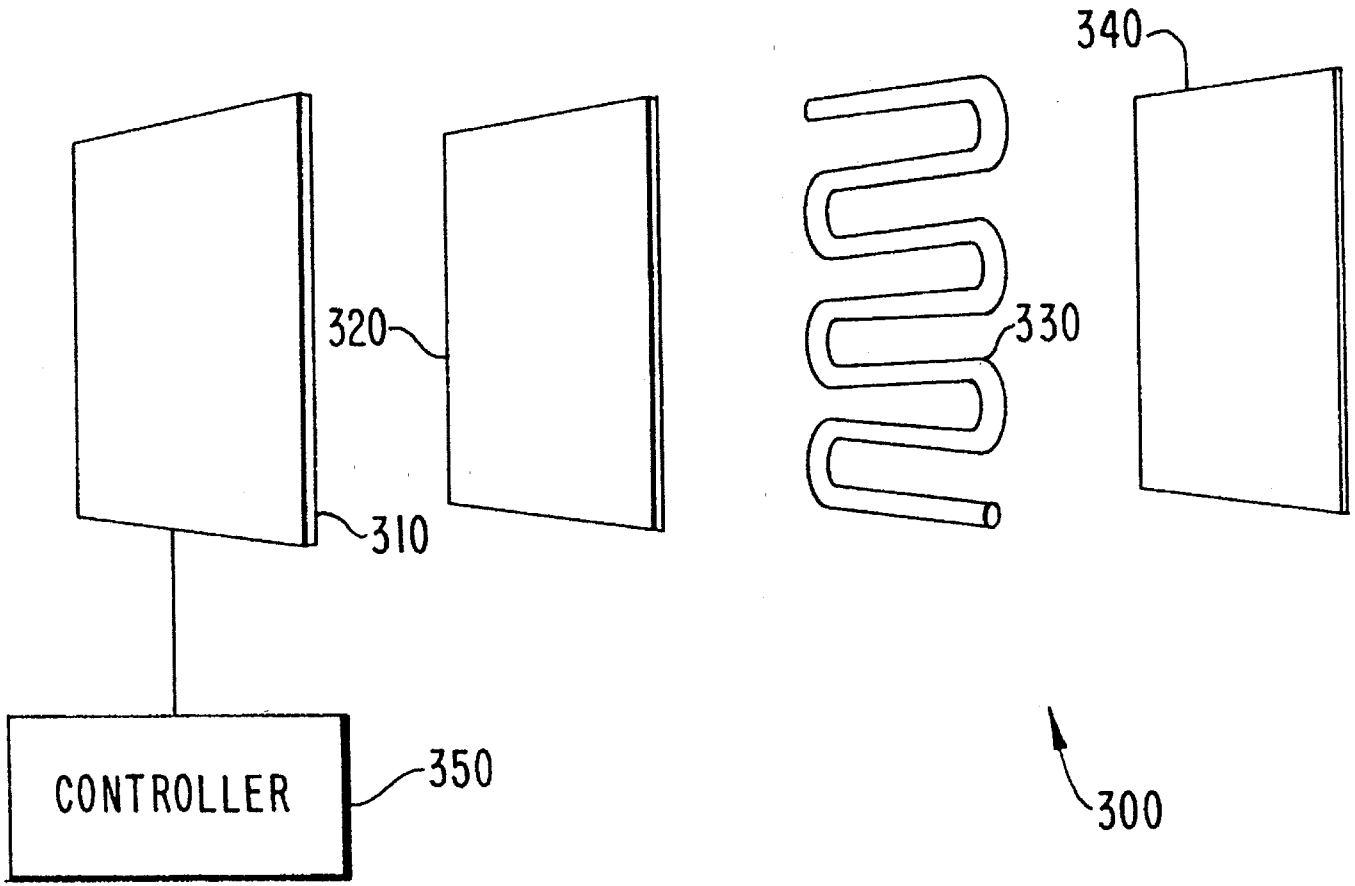
FIG. 6 illustrates a flat panel display according to another preferred embodiment of the invention.

FIG. 6 illustrates a simplified arrangement for a backlighted flat panel display 300 that employs the instant invention. Flat panel display 300 includes a transmissive AMLCD 310, a light diffuser 320, a fluorescent gas discharge lamp 330 employing the instant invention, and a back reflector 340. The fluorescent gas discharge lamp 330 uses a field emitter array having microscopic emitter elements to emit electrons into the tube of the lamp. These electrons in turn excite mercury atoms in the tube. The mercury atoms emit ultraviolet radiation when they relax, which causes a phosphor coating inside the tube to emit visible light for backlighting the display.

Electrical control signals provided to the AMLCD 310 from a controller 350 (e.g., a computer) cause light from lamp 330 to be either blocked or transmitted, thus creating an image on the face of the display 310 that is observed by an observer. (The observer is located to the left of the display in FIG. 6.)

The invention can be applied to a wide variety of applications in addition to those discussed above. In general, the invention can be used in any application requiring a source of electrons in a low pressure gas discharge environment. For example, the invention can be applied to semiconductor fabrication.

Therefore, although the invention has been described above with reference to certain specific embodiments, the scope of the invention is not limited to the embodiments described above. Other designs, modifications, and applications within the spirit and scope of the invention will be apparent to those skilled in the art after receiving the above teachings. The scope of the invention, therefore, is defined with reference to the following claims.

What is claimed is:

1. A gas discharge device, comprising:

an envelope containing a low pressure gas having a gas pressure greater than 0.1 Torr;

a field emitter array forming a cathode, said field emitter array having microscopic emitter elements which emit electrons into said gas;

an anode spaced from said cathode; and a first conductor connected to said cathode and a second conductor connected to said anode for supplying a voltage potential between said cathode and said anode upon operation of said gas discharge device such that a plasma sheath is formed about said microscopic emitter elements, said plasma sheath acting to extract electrons from said emitter elements and wherein said electrons produce a gas discharge which closes a circuit between said cathode and said anode.

2. A gas discharge device as set forth in claim 1, wherein said gas is at a pressure less than 10 Torr.

3. A gas discharge device as set forth in claim 1, wherein said microscopic emitter elements include rods protruding from a substrate, said rods having a maximum cross-sectional dimension less than 100 microns.

4. A gas discharge device as set forth in claim 1, wherein said microscopic emitter elements include rods protruding from a substrate, said rods having a maximum cross-sectional dimension between 0.01 and 100 microns.

5. A gas discharge device as set forth in any of claims 1, 2, 3, or 4, wherein said field emitter array includes tantalum disilicide rods in a silicon matrix.

6. A gas discharge device as set forth in any of claims 1, 2, 3, or 4, wherein said field emitter array includes tantalum disilicide rods in a silicon matrix and a layer of metal contacting both said rods and said matrix to bridge Schottky barriers between said rods and said matrix.

7. A gas discharge device as set forth in claim 5, wherein an areal density of said tantalum disilicide rods in said matrix is at least ten thousand per square centimeter.

8. A gas discharge device as set forth in claim 1, wherein an areal density of said microscopic emitter elements in said field emitter array is at least one thousand per square centimeter.

9. A gas discharge lamp, comprising:

an envelope containing a gas having a gas pressure greater than 0.1 Torr, said gas emitting photons when said gas is excited by electrons, said envelope being at least partially transparent to emit light;

a field emitter array forming a cathode, said field emitter array having microscopic emitter elements which emit electrons into said gas to excite said gas; and said gas discharge lamp, in operation, forming a plasma sheath about said microscopic emitters for extracting electrons from said emitter elements.

10. A gas discharge lamp as set forth in claim 9, further comprising:

an anode spaced from said cathode; and a first conductor connected to said cathode and a second conductor connected to said anode for supplying a voltage potential between said cathode and said anode upon operation of said gas discharge lamp wherein a gas discharge closes a circuit between said cathode and said anode.

11. A gas discharge lamp as set forth in claim 9, wherein said gas is mercury.

12. A gas discharge lamp as set forth in claim 9, wherein said gas is at a pressure less than 10 Torr.

13. A gas discharge lamp as set forth in claim 9, further comprising:

a phosphor coating to convert photons emitted by said gas into visible light.

14. A gas discharge lamp as set forth in claim 9, wherein said gas is mercury and further comprising a phosphor coating to convert photons emitted by said mercury into visible light.

15. A gas discharge lamp as set forth in any of claims 9, 10, 11, 12, 13, or 14, wherein said field emitter array includes tantalum disilicide rods in a silicon matrix.

16. A gas discharge lamp as set forth in any of claims 9, 10, 11, 12, 13, or 14, wherein said field emitter array includes tantalum disilicide rods in a silicon matrix and a layer of metal contacting both said rods and said matrix to bridge Schottky barriers between said rods and said matrix.

17. A gas discharge lamp as set forth in any of claims 9, 10, 11, 12, 13, or 14, wherein an areal density of said microscopic emitter elements in said field emitter array is at least one thousand per square centimeter.

18. A gas discharge lamp as set forth in claim 15, wherein an areal density of said tantalum disilicide rods in said matrix is at least ten thousand per square centimeter.

19. A gas discharge lamp as set forth in claim 9, wherein said field emitter array is at one end of said envelope and emits electrons into said gas during one portion of an oscillatory cycle, and wherein said gas discharge lamp further comprises an additional field emitter array forming an additional cathode at an opposite end of said envelope, said additional field emitter array having microscopic emitter elements which emit electrons into said gas during a second portion of said oscillatory cycle to excite said gas.

20. A method of producing light, comprising the steps of:

(a) providing a gas discharge enclosure containing a gas at a pressure greater that 0.1 Torr;

(b) providing an electric potential between a cathode and an anode, said cathode including a field emitter array having microscopic emitter elements arranged within said gas discharge enclosure; and (c) forming a plasma sheath about said microscopic emitter elements for causing electron emission from said microscopic emitter elements into said gas to form a gas discharge between said cathode and said anode that completes a circuit between said cathode and said anode and thereby generates light.

21. A flat panel display, comprising:

a layer of transmissive material which transmits and blocks light in accordance with control signals; and a gas discharge lamp to backlight said layer of transmissive material, said gas discharge lamp including;

(a) a gas discharge envelope containing a low pressure gas having a gas pressure greater than 0.1 Torr;

(b) an anode and a cathode spaced apart from one another;

(c) a field emitter array having microscopic emitter elements; and (d) a plasma sheath formed about said microscopic emitter elements for extracting electrons from said emitter elements into said gas.

22. A flat panel display as set forth in claim 21, wherein said field emitter array includes tantalum disilicide rods in a silicon matrix.

23. A flat panel display as set forth in claim 21, wherein said field emitter array includes tantalum disilicide rods in a silicon matrix and a layer of metal contacting both said rods and said matrix to bridge Schottky barriers between said rods and said matrix.

24. A method of producing a gas discharge, comprising the steps of:

(a) providing an electric potential between a cathode and an anode, said cathode including a field emitter array having microscopic emitter elements; and (b) forming a plasma sheath about said microscopic emitter elements for emitting electrons from said microscopic emitter elements into a gas discharge enclosure to form a gas discharge between said cathode and said anode, said gas having a gas pressure greater than 0.1 Torr and said gas discharge completing a circuit between said cathode and said anode.

25. A gas discharge lamp, comprising:

(a) a gas discharge enclosure containing a gas which emits photons when excited by electrons;

(b) a first cathode-anode assembly in said gas discharge enclosure, said first cathode-anode assembly including:

(1) a first field emitter array having microscopic emitter elements which emit electrons into said gas to excite said gas when said first cathode-anode assembly is connected to a first potential; and (2) a first collecting anode to collect electrons in said gas when said first cathode-anode assembly is connected to a second potential;

(c) a second cathode-anode assembly in said gas discharge enclosure, said second cathode-anode assembly including:

(1) a second field emitter array having microscopic emitter elements which emit electrons into said gas to excite said gas when said second cathode-anode assembly is connected to said first potential; and (2) a second collecting anode to collect electrons in said gas when said second cathode-anode assembly is connected to said second potential;

wherein, during operation of the discharge lamp, a plasma sheath is formed about at least one of said emitter arrays, said plasma sheath acting to extract electrons from said at least one emitter array.

26. A gas discharge lamp as set forth in claim 25, further comprising a mesh positioned in front of said first field emitter array, and wherein said first collecting anode is annularly shaped.

27. A gas discharge lamp as set forth in claim 25, wherein said first collecting anode is annularly shaped.

28. A gas discharge lamp as set forth in claim 25, wherein said first collecting anode is annularly shaped and wherein said first cathode-anode assembly further includes a mesh located in front of said first field emitter array in a center area of said first collecting anode.

29. A gas discharge lamp as set forth in claim 28, wherein said first cathode-anode assembly further includes a contact to hold said first field emitter array.

30. An ultraviolet gas discharge lamp, comprising:

an envelope containing a gas at a gas pressure greater that 0.1 Torr, and which emits ultraviolet light when said gas is excited by electrons, said envelope being at least partially transparent to ultraviolet light; and a field emitter array forming a cathode, said field emitter array having microscopic emitter elements and a plasma sheath formed about said emitter elements for extracting electrons from said emitter elements into said gas to excite said gas.

31. A method of illuminating a panel display while minimizing an infrared signature of said panel display, comprising the steps of:

(a) providing a panel display having a layer of transmissive material which transmits and blocks light in accordance with control signals and a gas discharge tube located to backlight said layer of transmissive material, said gas discharge tube including an envelope containing a gas, at a gas pressure greater that 0.1 Torr, which emits photons when said gas is excited by electrons and a field emitter array having microscopic emitter elements, said field emitter array forming a cold cathode for minimizing emission of infrared components from said gas discharge tube;

(b) providing an electric potential across said field emitter array having microscopic emitter elements;

(c) producing a plasma sheath for extracting electrons from said microscopic emitter elements into said gas through field emission;

(d) exciting atoms in said gas using said electrons emitted in step (c); and (e) permitting atoms excited in step (d) to relax and thereby generate light for backlighting said panel display.

32. A gas discharge lamp, comprising:

an envelope containing a gas having a gas pressure greater than 0.1 Torr, said gas including mercury, said mercury emitting photons when excited by electrons; and a field emitter array having uncoated microscopic tantalum disilicide rods, and, in operation, a plasma sheath formed about said rods for extracting electrons from said rods into said gas to excite said mercury and thereby produce light.

33. A panel display with a reduced infrared signature, comprising:

a layer of transmissive material which transmits and blocks light in accordance with control signals; and a gas discharge tube located to backlight said layer of transmissive material, said gas discharge tube including;

an envelope containing a gas, at a gas pressure greater than 0.1 Torr, which emits photons when said gas is excited by electrons; and a field emitter array having microscopic emitter elements, and, in operation, a plasma sheath formed about said emitter elements for extracting electrons from said emitter elements, said field emitter array forming a cold cathode for minimizing emission of infrared components from said gas discharge tube.

34. A method of producing free electrons, comprising the steps of:

(a) providing an electric potential between a cathode and an anode, said cathode including a field emitter array having microscopic emitter elements; and (b) forming a plasma sheath about said emitter elements for extracting electrons from said microscopic emitter elements into a gas discharge enclosure having a gas pressure greater than 0.1 Torr to form a gas discharge between said cathode and said anode, said gas discharge producing free electrons and completing a circuit between said cathode and said anode.

* * * * *